United States Patent [19]

Miller et al.

[11] Patent Number: 4,570,807

[45] Date of Patent: Feb. 18, 1986

[54] RAILWAY CAR UNDERFRAME

[75] Inventors: Roy W. Miller, Highland; Robert J. Kunst, Crown Point, both of Ind.

[73] Assignee: Pullman Standard Inc., Chicago, Ill.

[21] Appl. No.: 532,544

[22] Filed: Sep. 15, 1983

[51] Int. Cl.[4] ..... B61F 1/02

[52] U.S. Cl. ..... 213/60; 213/50; 105/420

[58] Field of Search ..... 213/50, 51, 58, 60, 213/50.5; 105/416, 418, 420, 3

[56] References Cited

U.S. PATENT DOCUMENTS

| | | | |
|---|---|---|---|
| 1,890,795 | 12/1932 | Spencer | 213/60 |
| 3,561,370 | 2/1971 | Reynolds | 105/420 |
| 3,858,729 | 1/1975 | Altherr | 213/67 R |

FOREIGN PATENT DOCUMENTS 0599823 6/1960 Canada .

*Primary Examiner*—Randolph A. Reese
*Assistant Examiner*—Dennis C. Rodgers
*Attorney, Agent, or Firm*—Richard J. Myers & Assoc.

[57] ABSTRACT

A railway car underframe comprises a center sill having bell mouth draft housings at opposite ends thereof. The housings accommodate the use of drawbars or shank type couplers. With the use of a shank type coupler a draft housing extension is secured to the bell mouth housings. The housings include structural shear elements interengageable with each other to align and secure the housings in rigid relation. The housings include connector plates secured together by fasteners with said connector plates longitudinally spaced apart to provide vertical spaces. Wedge elements having open end vertically spaced recesses are driven into the vertical spaces to provide for rigid metal to metal contact with the spaces accommodating the fasteners. Proper alignment, securement, and quick assembly therefore is achieved.

13 Claims, 7 Drawing Figures

RAILWAY CAR UNDERFRAME

BACKGROUND OF THE INVENTION

1. Field of Invention

The improvement relates to a railway car underframe which includes a center sill structure having at opposite ends thereof bell mouth shaped draft housings adapted to support drawbar as well as coupler arrangements.

2. Description of the Prior Art

Draft housings which are constructed to support drawbar structures, and coupler type housings are well known in the art and generally the center sills are specifically formed to utilize one or the other of the structures depending on the design which is chosen. In the present invention the ends of the center sill are adapted to utilize either a drawbar supported in bell mouth draft housings at opposite ends of the sill, or the ends of the sill are connected to sill extensions which are quickly attachable to provide for the modification necessary for adapting the sill for shank type coupler operation. The particular improvement described is not found in the prior art structures.

SUMMARY OF THE INVENTION

The primary object of the present invention is to provide a center sill underframe having draft housings at opposite ends thereof which may be readily adapted to utilize a drawbar or a shank type coupler. The present structure includes a bell mouth shaped housing at opposite ends of the center sill which will support a coupler or a drawbar, cushioned or non-cushioned. The opposite ends of the center sill include vertically extending attaching straps which have no function when the sill is used with a drawbar. However, when it is desired to use a coupler, a separate extension is attached to the sill which includes a relatively short housing structure having a complemental shape of the bell mouth housing which also includes attaching straps adapted to conform to and attach to the attaching straps of the bell mouth housing. Attachment is made by vertically spaced bolt and nut fasteners. The alignment of the bell mouth housing and the extension is quickly achieved by shear lugs laterally spaced and positioned on the top surface of the housing and a single shear lug positioned on the top surface of a horizontal wall at the bottom of the housing, the wall forming the lower surface of the center sill and draft housing structures. The extension includes upper and lower walls which have openings adapted to mate with the shear lugs thereby facilitating quick assembly at the extension with the sill and draft housings. When the alignment is completed, shims or wedges are drawn into the vertical spaces between the connecting straps.

The shims are provided with open end slots so as to conform to the vertically spaced bolt and nut fasteners. After the wedges are driven into place the fasteners are further tightened and the assembly is complete.

DESCRIPTION OF THE PREFERRED EMBODIMENT

Figures 1, 2, 3, 4:
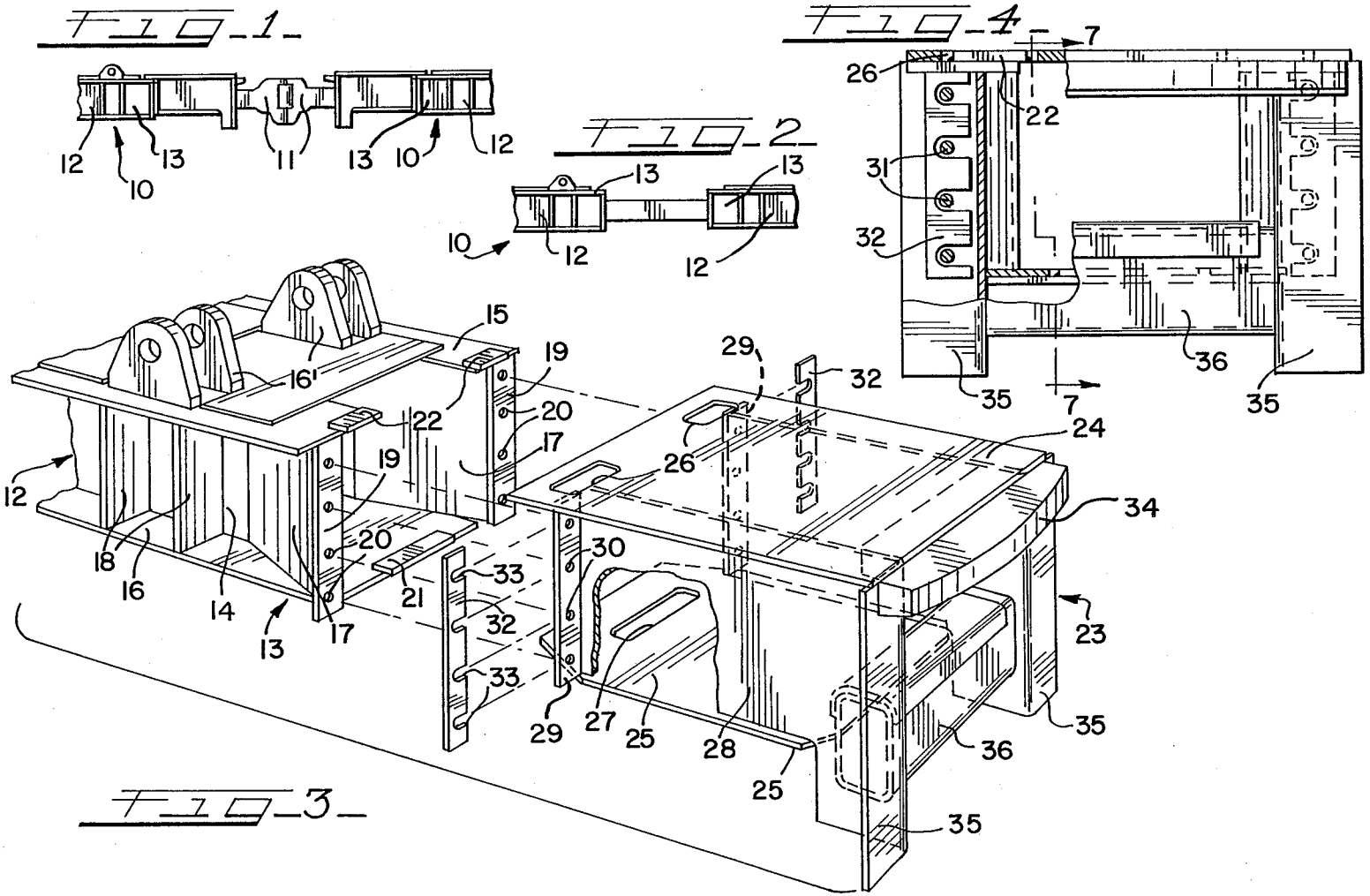
FIG. 1 is an elevational view of a pair of draft housings and center sill having housing extensions carrying a pair of interconnected couplers.
FIG. 2 is a similar view disclosing center sill draft housings which are interconnected by means of a drawbar.
FIG. 3 is an isometric view of a portion of a center sill underframe and draft housing disclosing a housing extension adapted to connect to said draft housing.
FIG. 4 is a front view of a housing extension with portions broken away to disclose an attaching means.
Figure 5:
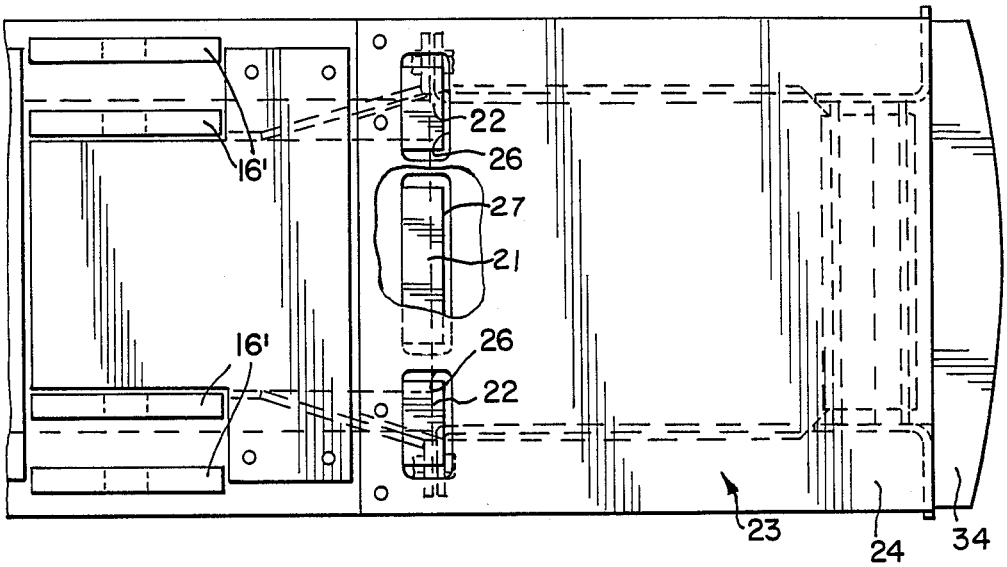
FIG. 5 is a plan view of one end of a draft housing with a housing extension connected thereto adapted to support a long shank coupler.

FIG. 1 discloses underframe members 10 coupled together by means of shank couplers 11. The underframes include center sills 12 provided at the ends of the sill with draft housings generally designated at 13 which are a continuation of the center sills. The center sill 12 is constructed, as shown in FIG. 3, in box shape fashion including a pair of upright walls such as wall 14, and a horizontal top wall 15 and a horizontal bottom wall 16. Lugs 16' are suitably connected to the top wall 15. The end of the draft housing 13 is bell shaped including outwardly diverging vertical walls 17. The draft housing 13 may include provisions for connecting the ends of either couplers or draft bars in conventional fashion and these connections are not shown in detail, being well known in the art. Also the couplers or drawbars may be suitably cushioned by cushioning means provided in the draft housings. As best shown in FIG. 3, the top and bottom walls 15 and 16, respectively, project laterally outwardly beyond the vertical walls 14 and vertical support brackets 18 are provided between the laterally projecting portions in the region of the lugs 16'. The forward end of the draft housing includes vertical attaching straps 19 having vertically spaced openings 20. The front end of the lower wall 16 has rigidly connected thereto a lower shear lug 21 and the upper wall 15 has connected thereto laterally spaced shear lugs 22. A coupler support housing or extension assembly is generally designated at 23.

Figure 6:
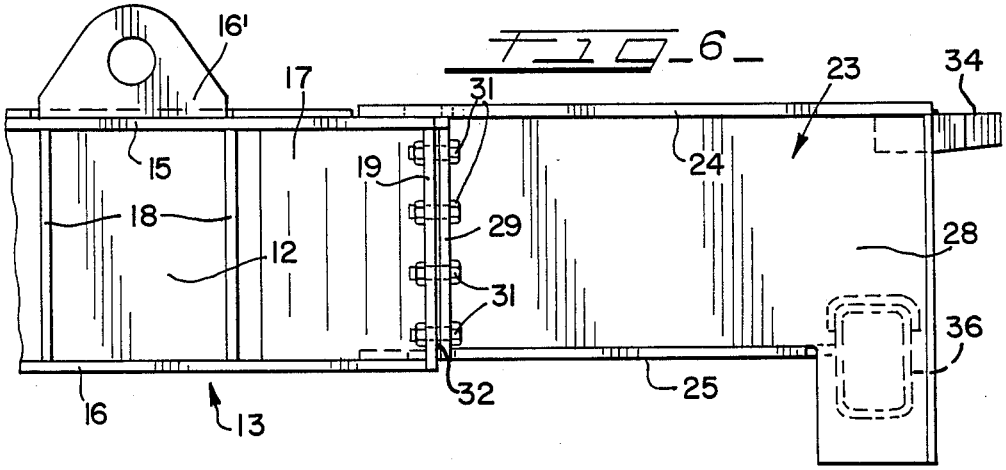
FIG. 6 is a side elevational view of the draft housing and extension therefor.
Figure 7:
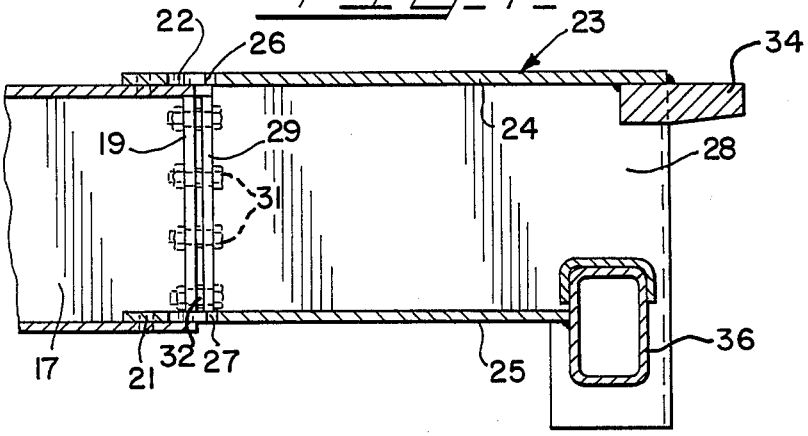
FIG. 7 is a cross sectional view taken along the line 7—7 of FIG. 4.

The housing 23 is capable of quick attachment and detachment from the draft housing 13. The housing 23 includes an upper wall 24 and a lower wall 25. The upper wall 24 is provided with alignment openings 26 and the lower wall 25 includes an alignment opening 27. Vertical walls 28 connected to the top and bottom walls 24 and 25 have rigidly supported thereon attaching straps 29 which have a plurality of vertically spaced openings 30. Openings 30 are arranged to conform in registry with, or to be aligned with, the openings 20 which in assembly are connected together by means of bolt and nut fasteners 31. Wedge elements 32 include open end slots 33 and these are driven into position indicated in FIGS. 4 and 6 whereupon the bolts are further tightened to effectively connect the draft housing and extension in assembly.

The housing 23 includes a forwardly extending bumper portion 34 and depending angle portions 35 which support a tubular coupler support cross member 36 on which a shank type coupler 11 may be supported. FIG. 2 shows the draft housings 13 interconnected by means of a drawbar which also may be cushioned or not cushioned as desired.

THE OPERATION

The drawbar and coupler constructions are not disclosed in detail since they are well known in the art. The invention resides in the connection of the draft bell housing with the extension housing so as to convert the same from a drawbar arrangement to a shank type coupler operation.

When it is desired to convert from the drawbar to coupler operation the housing 23 is simply connected in assembly by moving the housings 23 and 13 together. Alignment is accurately achieved by aligning the lugs 22 in the openings 26 of the housing 23. Simultaneously the lower lug 21 is received in the alignment slot 27 whereupon the straps and opening therein are in registry and the bolt and nut assemblies are inserted and secured. During this operation the wedges 32 are driven into the slots between the straps and further tightening of the bolts and nuts provides a rigid assembly which can quickly be changed over to drawbar operation when desired. A strong rigid interconnection is assured and disassembly can be achieved quickly and effectively. The assembled housings provide an integral structure with positive metal to metal contact which when assembled creates a rigid unitary structure.

The above described shear lugs 21 and 22 provide for quick and positive alignment of the two structures but their primary purpose is to transfer the shear loads in the working of the sill structure.

The coupler carrier tube 36 carries the weight of the coupler and normally receives up to 50,000 lbs. vertical force under extreme train action. The AAR ruling requires a structure capable of supporting an upward force of 50,000 lbs. if necessary to re-rail a car by lifting the coupler shank.

Thus it is apparent that the forces encountered tend to pry the sill extension pocket up or down. If the shear lugs 21 and 22 were not used, the downward forces would be resisted by placing the top two bolts of the vertical straps in tension and the metal to metal at the bottom of the side straps. Thus, if the top bolts break, the next two would resist the load until they also would break creating a zipper effect until the sill extension would break off.

The shear lugs 22 on the top corners provide for load resistance by resisting the force in shear against its welds; this being the most effective way for a weld to function. The shear lug 21 on the bottom plate 16 resists the upward load forces in the same manner. To function effectively the vertical inboard surfaces at the shear lug must be in bearing contact with the outboard vertical surface at the corresponding slot in the sill extension. When the sill extension is assembled to the center sill, and shear lug surface is drawn tight against its corresponding slot, a gap will result between the side vertical straps 19 and 29.

In order to maintain solid metal to metal contact, it is necessary to shim the gap with the filler 32. Thus it is clear that the lugs 21 and 22 function as shear lugs in transferring shear loads.

What is claimed is:

1. A railway car underframe comprising a center sill including first upright side walls and upper and lower horizontal walls, a draft housing provided at an end of said sill including vertical sill wall portions tapering diagonally outwardly to provide a bell mouth configuration adapted to connect a drawbar to said housing for swinging draft movement, the improvement of a coupler support housing including second upright and lower and upper horizontal walls conforming to said first walls, connecting means between said draft housing and said support housing releasably securing said support housing to said draft housing to provide an extension thereof, said support housing including a transversely extending coupler support, first shear means on said draft housing, second shear means on said coupler support housing, and said first shear means intercoupling with said second shear means, said first shear means and said second shear means having means opposing said second shear means in shear loading when the draft housing and the coupler support housing are drawn apart.

2. The railway car underframe in accordance with claim 1, the means opposing of said first shear means and said second shear means including first projections on one of said housings, and recesses on the other of said housings receiving said projections.

3. The railway car underframe in accordance with claim 1, said interengageable sheet means also providing for horizontal alignment of said housings.

4. A railway car underframe comprising a center sill including first upright side walls and upper and lower horizontal walls, a draft housing provided at an end of said sill including vertical sill wall portions tapering diagonally outwardly to provide a bell mouth configuration adapted to connect a drawbar to said housing for swinging draft movement, the improvement of a coupler support housing including second upright and lower and upper horizontal walls conforming to said first walls, connecting means between said draft housing and said support housing releasably securing said support housing to said draft housing to provide an extension thereof, said support housing including a transversely extending coupler support, first shear means on said draft housing, second shear means on said coupler support housing, and said shear means being interengageable during assembly of said housings to secure said housings in said position of extension adapted to support a coupler therein, said connecting means on said housings including vertical connecting straps laterally spaced and supported on the adjacent ends of said housings, and fasteners releasably securing said straps and housing in connected relation.

5. The railway car underframe in accordance with claim 4, said straps being positioned apart longitudinally to provide vertical spaces therebetween.

6. The railway car underframe in accordance with claim 5, including wedge means secured within said vertical spaces.

7. The railway car underframe in accordance with claim 6, said wedge means providing rigid contact between said connector straps.

8. The railway car underframe in accordance with claim 6, said fasteners comprising vertically spaced connectors.

9. The railway car underframe in accordance with claim 8, said wedge means including open end recesses within which said connectors are disposed.

10. A railway car underframe comprising a center sill including first upright side walls and upper and lower horizontal walls, a draft housing provided at an end of said sill including vertical sill wall portions tapering diagonally outwardly to provide a bell mouth configuration adapted to connect a drawbar to said housing for swinging draft movement, the improvement of a coupler support housing including second upright and lower and upper horizontal walls conforming to said first walls, connecting means between said draft housing and said support housing releasably securing said support housing to said draft housing to provide an extension thereof, said support housing including a transversely extending coupler support, first shear means on said draft housing, second shear means on said coupler support housing, and said first and second shear means being interengageable during assembly of said housings to secure said housings in said position of extension adapted to support a coupler therein, said first and second shear means including first projections on one of said housings and recesses on the other of the housings receiving said projections, said connecting means including connecting straps on adjacent ends of said housing adapted to be releasably connected together.

11. A railway car underframe comprising a center sill including first upright side walls and upper and lower horizontal walls, a draft housing provided at an end of said sill including vertical sill wall portions tapering diagonally outwardly to provide a bell mouth configuration adapted to connect a drawbar to said housing for swinging draft movement, the improvement of a coupler support housing including second upright and lower and upper horizontal walls conforming to said first walls, connecting means between said draft housing and said support housing releasably securing said support housing to said draft housing to provide an extension thereof, said support housing including a transversely extending coupler support, first shear means on said draft housing, second shear means on said coupler support housing, and said first and second shear means being interengageable during assembly of said housings to secure said housings in said position of extension adapted to support a coupler therein, said first and second shear means comprising interengageable positioning elements.

12. A railway car underframe comprising a center sill including first upright sidewalls and upper and lower horizontal walls, a draft housing provided at an end of said sill including vertical sill wall portions tapering diagonally outwardly to provide a bell mouth configuration adapted to connect a drawbar to said housing for swinging draft movement, the improvement of a coupler support housing including second upright and lower and upper horizontal walls conforming to said first walls, connecting means between said draft housing and said support housing releasably securing said support housing to said draft housing to provide an extension thereof, said support housing including a transversely extending coupler support, first shear means on said draft housing, second shear means on said coupler support housing, said first and second shear means being interengageable during assembly of said housing to secure said housings in said position of extension adapted to support a coupler therein, and means holding the first and second shear means in tight abutting relation in rigidifying the draft housing and the support housing in the position of extension.

13. A railway car underframe comprising a center sill including first upright side walls and upper and lower horizontal walls, a draft housing provided at an end of said sill including vertical sill wall portions tapering diagonally outwardly to provide a bell mouth configuration adapted to connect a drawbar to said housing for swinging draft movement, the improvement of a coupler support housing including second upright and lower and upper horizontal walls conforming to said first walls, said support housing including a transversely extending coupler support, first shear means on said draft housing, second shear means on said coupler support housing, said first and second shear means being interengageable during assembly of said housings to secure said housings in a position of extension adapted to support a coupler therein, and means holding the first and second shear means in tight abutting relation in rigidifying the draft housing and the support housing in the position of extension.

* * * * *